United States Patent [19]

Nicoletti

[11] Patent Number: 4,750,743

[45] Date of Patent: Jun. 14, 1988

[54] PLAYING CARD DISPENSER

[75] Inventor: Adolph E. Nicoletti, Berlin, N.J.

[73] Assignee: PN Computer Gaming Systems, Inc., Berlin, N.J.

[21] Appl. No.: 909,368

[22] Filed: Sep. 19, 1986

[51] Int. Cl.[4] ..... A63F 1/14

[52] U.S. Cl. ..... 273/148 A; 211/51; 271/160; 273/149 R

[58] Field of Search ..... 273/148 A, 149 R; 211/59.2, 59.3, 51; 271/24, 25, 109, 160, 149, 264

[56] References Cited

U.S. PATENT DOCUMENTS

| | | | |
|---|---|---|---|
| 842,803 | 1/1907 | Murch | 273/149 R |
| 1,043,109 | 11/1912 | Hurm | 273/149 R |
| 1,383,570 | 7/1921 | Schnell | 273/148 A UX |
| 1,824,542 | 10/1929 | Hangerud | 273/149 R |
| 1,847,346 | 4/1929 | Lux | 273/149 R |
| 2,001,220 | 1/1932 | Smith | 273/149 R |
| 2,185,474 | 11/1937 | Nott | 273/149 R |
| 2,659,607 | 5/1950 | Skillman et al. | 273/149 R |
| 2,755,090 | 9/1952 | Aldrich | 273/149 R |
| 2,766,989 | 2/1954 | Sivertson | 273/149 R |
| 2,815,214 | 4/1954 | Hall | 273/149 R |
| 3,147,978 | 1/1958 | Sjostrand | 273/149 R |
| 3,929,339 | 12/1975 | Mattioli | 273/148 A |
| 4,310,160 | 1/1982 | Willette et al. | 273/149 R |
| 4,352,022 | 9/1982 | Britton | 271/149 X |
| 4,377,285 | 3/1983 | Kadlic | 273/148 A |
| 4,457,512 | 7/1984 | Stevenson | 273/148 A |
| 4,513,969 | 4/1985 | Samsel, Jr. | 273/149 R |

FOREIGN PATENT DOCUMENTS

| | | | |
|---|---|---|---|
| 277216 | 8/1914 | Fed. Rep. of Germany | 273/149 R |
| 24238 | 3/1922 | France | 273/149 R |
| 542658 | 8/1922 | France | 273/149 R |
| 480881 | 5/1953 | Italy | 273/149 R |

*Primary Examiner*—Anton O. Oechsle

*Attorney, Agent, or Firm*—Panitch Schwarze Jacobs and Nadel

[57] ABSTRACT

A dispenser for playing cards includes a shoe adapted to contain stacked playing cards and dispense a single card at a time. The shoe includes a front wall adapted to conceal the leading card of the stack. A slot sized to permit a playing card to pass through is positioned adjacent the floor and front wall. The dispenser also includes a card pusher adapted to urge the stack cards down an inclined floor and a contact roller for dispensing cards. An endless belt located in an opening in the front wall engages the contact roller. The belt also securely engages a pair of inner rollers spaced by a predetermined distance such that displacement of the belt by the operator through the predetermined distance causes rotation of the contact roller to advance the leading card into and substantially out of the slot. The predetermined distance is preferably selected to approximate the distance which operators are accustomed to move the leading card when dealing the leading card from a manual shoe. In another embodiment, which permits a larger stack of cards to be loaded into the dispenser, the floor of the shoe contains an elongated aperture. The card pusher, which extends through the aperture, includes a pusher plate located above the floor for contacting the trailing card, and a weight located below the floor.

21 Claims, 3 Drawing Sheets

PLAYING CARD DISPENSER

BACKGROUND OF THE INVENTION

This invention relates generally to a dispenser for playing cards and more specifically to a card dispenser adapted to reduce the likelihood that the identity or characteristics of cards delivered from the dispenser can be predicted.

In many games of chance employing cards, individual cards are selected one at a time from a card stack. Assuming a random arrangement of a set of unique cards in the stack, the probability that a specific card will be drawn from the stack is simply expressed mathematically. In the case of the first card drawn, the probability is just the reciprocal of the number of cards in the stack. If the drawn card is randomly replaced in the stack after every draw, the probability of drawing a specific card on any draw will be the same. When the drawn card is not replaced, the probability of selecting a specific remaining card or one of a specific class of remaining cards from the stack increases. Further, the identity of the cards already drawn is known and the likelihood that a specific card or one of a specific class of cards will be drawn can be predicted by the astute player.

In professional gambling games, it is desirable to draw cards from a stack in a manner which approximates the drawing with replacement described above. House rules can be established to provide the house with a statistically fixed proportion of the bets, based on the probability that a specific card will be drawn.

"Card counters" are individual bettors who carefully monitor the cards played from a particular stack so that they predict the changing probability of a specific card being dealt and bet accordingly. Card counting is an integral part of many gambling games. While drawing with replacement minimizes the effect of card counting, the replacement of individual cards is impractical in gambling casinos. Indeed, operators of gambling casinos have in the past approximated drawing with replacement by forming the card stack from multiple decks of cards and relatively frequent shuffling. While these methods significantly reduce the losses which operators might otherwise experience from the bets of card counters, skillful counters are often able to glean valuable information by observing individual cards in the card stack. There is a significant need for a device for dispensing playing cards which further reduces the ability of card counters to reduce net house winnings.

SUMMARY OF THE INVENTION

The present invention is a dispenser for playing cards, including a shoe adapted to contain a plurality of stacked playing cards. The playing cards include a leading card and a trailing card. The shoe includes a back wall, first and second side walls, a front wall, a base and an inclined floor extending from the back wall to proximate the front wall and adapted to support the playing cards. The floor is inclined downwardly from the back wall to the front wall. The front wall is adapted to conceal the leading card. The front wall, base, side walls, and floor enclose a slot positioned adjacent the floor, the slot being sized to permit a playing card to pass through the slot.

The dispenser further includes card advance means contacting the trailing card and adapted to urge the stacked cards down the inclined floor, as well as card dispensing means positioned in the front wall and adapted to dispense a single card at a time. The card dispensing means includes leading card contact means adapted for rotation about an axis parallel to the leading card. Rotation of the leading card contact means displaces the leading card relative to the card stack and into a predetermined position extending out of the shoe from the slot.

In a preferred embodiment, the leading card contact means includes a generally cylindrical contact roller for contacting the leading card. Rotation of the contact roller advances the leading card into and at least partially out of the slot for dispensing the leading card. In the same embodiment, the dispenser has an endless belt located in an opening in the front wall for contacting the contact roller. The endless belt securely engages a pair of spaced inner rollers rotatably mounted in the front wall. The inner rollers are spaced by a predetermined distance such that displacement of the endless belt by the operator through the predetermined distance causes rotation of the contact roller to advance the leading card into and substantially out of the slot. The predetermined distance is preferably selected to approximate the distance which operators are accustomed to moving the leading card when dealing the leading card from a manual shoe.

Optionally, but preferably, the dispenser also includes also one, but preferably a plurality of removal rollers. The removal roller or rollers are mounted on the dispenser and positioned below the leading card contact means. The removal roller has an outer cylindrical surface in which a tangent plane is generally flush with the floor of the dispenser, whereby rotation of the leading card contact means displaces the leading card relative to the card stack such that the leading card extends out of the shoe from the slot and is supported by the removal roller or rollers.

To help prevent the leading card extending from the slot from being displayed prematurely, upstanding shoulders may be formed adjacent the sides of the dispenser and in front of the slot. Although shoulders may be formed on both sides of the floor, it is presently preferred that the shoulder be formed only on the right side of the floor front of the shoe looking from the back wall to the front wall of the dispenser. The shoulder may be integral with the side wall and may form one support for one end of the removal rollers.

In another embodiment, which need not, but preferably does include the leading card dispensing and contact means, the floor contains an elongated aperture extending from proximate the back wall to proximate the front wall of the shoe and the card advance means extends through the aperture and the floor. In this embodiment, the card advance means includes a pusher plate located above the floor for contacting the trailing card and gravitational advance means located below the floor. In this embodiment, the dispenser can be loaded with a larger stack of cards than would be otherwise possible.

Preferably, the dispenser further includes means for detecting and signaling advancement of the card advance means beyond at least one predetermined position. For example, the dispenser may signal that sufficiently few cards remain in the stack to be dealt so that it is desirable to reload the dispenser with a fresh stack of cards. In this case, the operator or dealer is alerted to the fact that few cards remain to be dealt. Card counting is especially efficacious when only a few cards remain in the shoe.

BRIEF DESCRIPTION OF THE DRAWINGS

The foregoing summary, as well as the following detailed description of the presently preferred embodiments of the invention, will be better understood when in conjunction with the appended drawings, it being understood, however, that this invention is not limited to the precise arrangements illustrated. In the drawings.

DETAILED DESCRIPTION OF THE PREFERRED EMBODIMENTS

Figure 3:
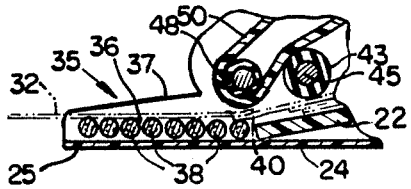
FIG. 3 is a partial vertical sectional view of the dispenser taken generally along the plane of line 3—3 of FIG. 1.
Figure 1:
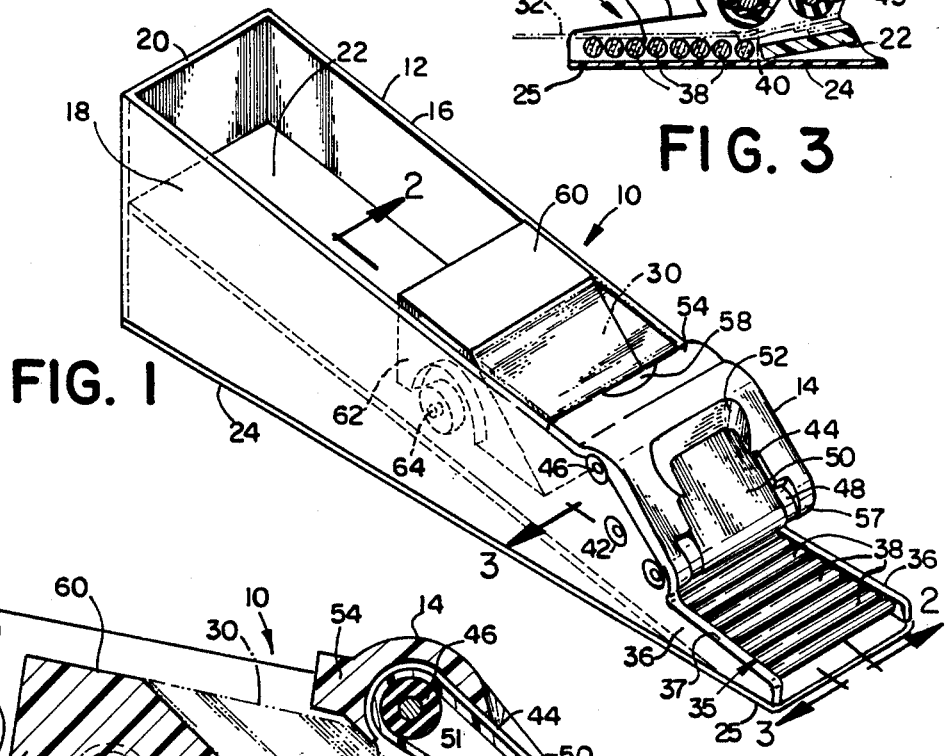
FIG. 1 is a perspective view of a dispenser for playing cards in accordance with one preferred embodiment in the present invention.
Figure 2:
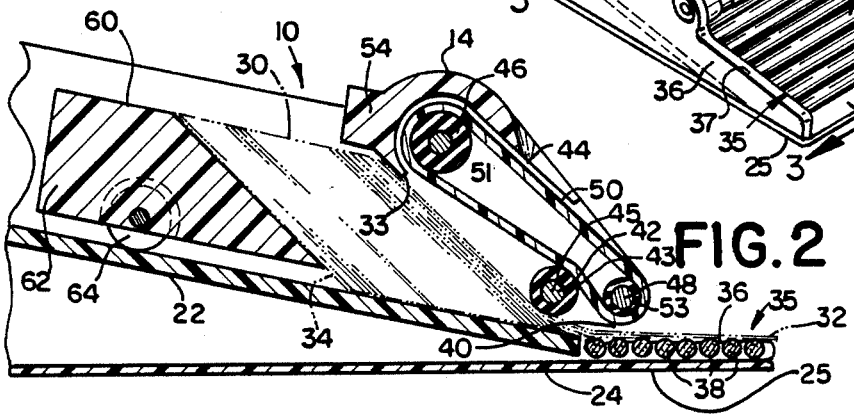
FIG. 2 is a partial vertical sectional view of the dispenser taken generally along the plane of line 2—2 of FIG. 1.
Figure 4:
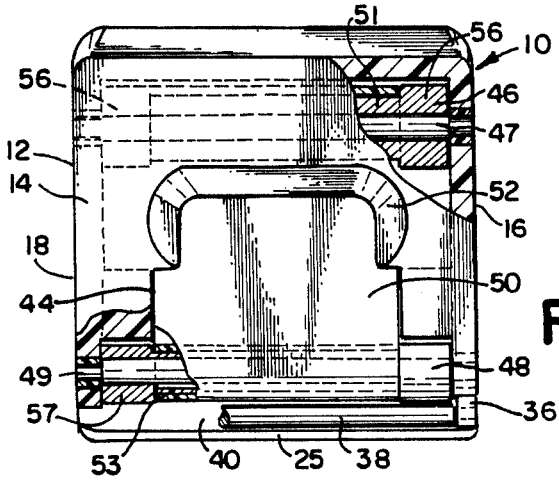
FIG. 4 is a partial vertical sectional front elevational view of the dispenser of FIG. 1.

Referring now to FIGS. 1-3, there is shown a dispenser for playing cards 10 according to one presently preferred embodiment of the present invention. The dispenser 10 includes a shoe 12 adapted to contain a plurality of playing cards 30 including a leading card 32 and a trailing card 34. The shoe 12 includes a front wall 14, first and second spaced, generally parallel side walls 16, 18, a back wall 20, a base 24 and a floor 22. Side wall 16 is designated the left side wall and side wall 18 is designated the right side wall looking from the back wall 20 to the front wall 14. The floor 22 is inclined downwardly from the back wall 20 to the front wall 14 and is adapted to support the playing cards 30. The inclined floor 22 terminates proximate the front wall 14 adjacent the base 24 which extends further forward beyond the front wall 14, as best seen in FIG. 2. Cards 30 are delivered from the dispenser 10 through a slot 40 which is sized to permit a playing card 30 to pass through the slot 40 and which is enclosed by the front wall 14, the side walls 16, 18, the floor 22, and the base 24.

In contrast to prior art dispensers in which the front wall contains an aperture permitting the operator or dealer to contact the leading card, to slide the leading card down and out of the dispenser and through which the leading card can be seen, the front wall 14 of the dispenser 10 of the present invention is adapted to conceal the leading card 32 from view. Skilled card counters are often able to recognize and identify specific cards in a stack by observing minute imperfections and other characteristic differences on the backs of the cards. The dispenser 10 of the present invention prevents the card counter from making such observations and thus eliminates the advantage which such observations give the card counter over the house and other players.

The leading card 32 is not visible to the operator or players until the leading card 32 is dispensed by the operator or dealer. A card dispensing means is positioned in the front wall 14 and is adapted to dispense a single card at a time. The card dispensing means of the present embodiment includes a leading card contact means or generally cylindrical contact roller 42. The contact roller 42 is adapted for rotation about an axis parallel to and spaced from both the leading card 32 and the inclined floor 22, as best seen in FIG. 2. The circumference of the contact roller 42 preferably is smaller than the size of the cards 30, and specifically, is smaller than the shorter dimension of the generally rectangular cards 30. If desired, the circumference of the contact roller 42 may be equal to or greater than the shorter dimension of the cards 30. If this is the case, the cards 30 would be dispensed completely out of the slot by a single rotation of the contact roller 42. In most instances, it is preferred that the circumference of the contact roller 42 be smaller than the shorter dimension of the cards 30 so that the leading card 32 extends significantly, though not completely, out of the slot 40. This allows the operator or dealer to better control the cards as they are dispensed from the shoe.

As shown in FIG. 1, the contact roller 42 is rotatably mounted in bearings positioned in the side walls 16, 18 proximate the front wall 14. The contact roller 42 includes a central rotatable shaft 45 supported by the bearings and an outer covering 43 preferably formed from a resilient and preferably elastomeric material, such as rubber, which is adapted to positively and frictionally engage the surface of the playing cards 30. The outer covering 43 is securely affixed to the shaft 45. The contact roller 42 is mounted in the shoe 12 such that it contacts the leading card 32 proximate the bottom of the leading card 32. Rotation of the contact roller 42 (counterclockwise in FIG. 2) causes the leading card to be displaced down and at least partially out through the slot 40.

The contact roller 42 may be rotated by any suitable means. In the present embodiment, the contact roller 42 is rotated by movement of an endless band or belt 50 which engages the exterior surface of the contact roller 42. The belt 50 is formed from a resilient, preferably elastomeric material which positively and frictionally engages the contact roller 42. The presently preferred material is a silicone rubber treated with additives to reduce deterioration caused by exposure to ultraviolet light, oils and moisture from an operator's hand, and the like. The belt 50 is in turn moved by the operator of the dispenser 10. As best seen in FIG. 2, the belt 50 is mounted on and extends between a pair of spaced generally cylindrical inner rollers 46, 48. The inner rollers 46, 48 include an upper inner roller 46 and a lower inner roller 48 which are spaced by a predetermined distance such that displacement of the endless belt 50 by the operator by a distance equal to the predetermined distance causes rotation of the contact roller 42 to advance the leading card 32 into and substantially out of the slot 40 and into a predetermined position. Preferably, the card extends from the slot a sufficient distance to be easily grasped by a dealer for distribution to the players.

The exterior surface of the endless belt 50 is accessible to the operator through an opening 44 formed in the front wall 14, best seen in FIGS. 1 and 3. A beveled guide edge 52 is provided proximate the top of the opening 44 in the front wall 14 to aid the operator in locating the belt 50 by touch and advancing the belt 50 in a single motion. The endless belt and opening are located in such a manner and the inner rollers are spaced to approximate the distance which operators or dealers are accustomed to moving the leading card when dealing the leading card from a manual shoe. Thus, a dealer may use the same general motion to dispense a card from the present invention that would be used in dispensing a card from a manual shoe.

Each of the inner rollers 46, 48 includes a rotatable generally cylindrical shaft 47, 49. The ends of the shafts 47, 49 are rotatably mounted in bearings positioned in the side walls 16, 18. A pair of spaced generally cylindrical guides 56, 57 are securely affixed to or integral with the shafts 47, 49 proximate the side walls 14, 16. The guides 56, 57 function to center the belt 50 on the inner rollers 46, 48. The shafts 47, 49 of the inner rollers 46, 48 are covered with generally cylindrical sleeves 51, 53 extending between the guides 56, 57. The sleeves 51, 53 may be formed from a resilient, preferably elastomeric material adapted to positively and frictionally engage the inner surface of the belt 50 so that the belt 50 can be moved on the inner rollers 46, 48 without slipping or shifting from side to side and becoming misaligned.

As best illustrated in FIGS. 1 through 3, to aid in removing a leading card 32 from the slot 40, there is preferably provided a removal roller assembly 35 comprising at least one and preferably a plurality of aligned removal rollers 38. The removal rollers 38 are retained in a removal roller frame assembly 36.

Roller frame assembly 36 comprises left and right side supporting members generally aligned with the left side wall 16 and the right side wall 18 of the shoe 12. As illustrated, it is preferred that the support members forming the removal roller frame assembly 36 be formed integrally with the side walls 16 and 18. If desired, the removal roller frame assembly could be separately secured to a forward extension 25 of the base 24 by means of a suitable bonding agent, screws, or other fastening means.

In the presently preferred embodiment, there are eight removal rollers each of which have a length equal to the inside width of the shoe 12. This width is slightly greater than the longest dimension of the cards 30. The first removal roller 38 to be contacted by the leading card 32 being dispensed by the contact roller 42 is mounted on the dispenser and positioned below and forward of the contact roller 42. In a prototype of this embodiment, the first removal roller 38 is positioned about ¼ inch in front of the contact roller 42, although other distances may be used if desired based on the thickness and other characteristics of the cards, and other factors. The outer cylindrical surfaces of the removal rollers preferably include a tangent plane generally flush with the upper surface of the floor 22 to provide for the smooth dispensing of the leading card 32 through the slot 40. Thus, the first removal roller 38 is located within the shoe at the entry point of the leading card 32 into the slot 40. Although eight freely rotating removal rollers 38 are illustrated as being used in the presently preferred embodiment, any number of removal rollers could be used if desired. It is preferred that a sufficient number of removal rollers be used such that the leading card 32, when extending completely from the slot 40 can be substantially supported by the top portion of the outer cylindrical surfaces of the removal rollers.

The removal rollers 38 each preferably comprises an internal shaft of a durable material, such as stainless steel, with an outer coating of a friction material such as silicone rubber of the type used to make the endless belt 50.

As best illustrated in FIGS. 1 and 3, an upstanding shoulder 37 is formed on the right support member of the removal roller frame assembly 36 which is aligned with right side wall 18. The shoulder preferably is integrally formed with the support member and the right side wall 18. The purpose of the shoulder is to help prevent an operator from prematurely lifting the card from the removal roller assembly 35 so that no player has an advantage by seeing a portion of the card that other players do not see. The shoulder prevents the leading card 32 from being slid off of the top surface of the removal rollers 38 toward the right side wall 18 without lifting up the leading card. The shoulder also helps guide the operator's hand and provides for a more uniform dealing motion.

Although the left frame support member of the removal roller frame assembly 36 may also have an upstanding shoulder formed on it, it is presently preferred that the left support member as best illustrated in FIGS. 1 and 2 have a height which is substantially flush with the top of the outer cylindrical surfaces of the rollers 38. This allows the operator or dealer to slide the leading card 32 off of the roller assembly in a direction toward the left side wall 16. Since the sliding of the leading card 32 toward the right side wall 18 is prevented by the shoulder 37 aligned with the right side wall 18, by the repetition associated with dispensing the cards and dealing them from the shoe, the operator's hand motion quickly becomes repetitive, efficient, automatic and quite uniform.

As best seen in FIG. 2, the front wall 14 includes a generally rectangular cover 54 extending backward above the cards 30 and generally parallel to the inclined floor 22. The cover 54 is adapted to shield from view the top edges of stack of cards 30 located proximate the leading card 32. The cover 54 can be extended further backwards to cover any portion of the shoe 12 desired. However, the cover 54 is preferably sized to permit ready access to the stack of cards 30 from above as by means of a cutout 58.

The front wall 14 also includes a shoulder 33 formed on the inside of the front wall 14 and positioned proximate the top edge of the leading card 32. The shoulder 33 prevents the shoe 12 from being reloaded with cards inserted through the slot 40. While a single card may be inserted through the slot 40 and the belt 50 rotated (counterclockwise in FIG. 2) to turn the contact roller 42 to draw the card up into the dispenser 10 (not illustrated), a card inserted in this manner will not be added to the stack of cards 30. Instead, the top edge of the card will contact the shoulder 33 and a portion of the card will continue to protrude through the slot 40. Thus, the shoulder 33 prevents the dispenser 10 from being reloaded through the slot 40 with a sequence of cards which have already been dispensed.

A gravitationally advanced card advance means or card pusher 60 is provided to contact the trailing card 34 of the stack of cards 30. The card pusher 60 includes a housing 62 and a roller 64 adapted to contact the inclined floor 22. The front surface of the housing 62 forms an acute angle with the inclined floor 22 when the card pusher 60 is positioned in the dispenser 10. The front surface of the housing 62 generally parallels the rear surface of the front wall 14 so that the adjacent stack of cards 30 is angled rearwardly at about the same angle as the front wall.

In operation, the dispenser 10 is preferably filled with a stack of cards 30 including multiple decks of preshuffled cards. The side walls 16, 18 are preferably spaced to permit the cards 30 to be loaded into the dispenser 10 with the longer dimension of the generally rectangular cards 30 oriented horizontally. The card pusher 60 is pushed manually by the operator up the inclined floor 22 to provide room for the cards 30 to be inserted from above. The cards 30 are then dealt one at a time by the operator who moves the belt 50 in a single motion to advance the leading card 32 into and through the slot 40 and onto the removal roller assembly 35. The operator subsequently grasps the card protruding from the slot 40 and supported by the rollers 38 and deals it.

The operator continues to dispense the cards 30 until only a predetermined number of cards remain in the dispenser 10. This point may be signalled by a "cut card" which is oriented with its long dimension perpendicular to the card floor 22 so that it protrudes from the stack of cards 30 (not illustrated). Thus, when the "cut card" approaches or contacts the cover 54, the operator is alerted to refill the dispenser 10 with fresh cards. The cutout 58 is formed in the rear edge of the cover 54 to facilitate removal of cards beyond the "cut card".

A second presently preferred embodiment of the present invention is illustrated in FIGS. 5–9. For the sake of convenience, the same numbers are used for common elements of the first embodiment of FIGS. 1–4 and the second embodiment of FIGS. 5–9, except that in the second embodiment, the corresponding reference numerals are primed. Where the structure of the second embodiment is different from the structure of the first embodiment of FIGS. 1–4, unprimed reference numerals are used. Although it is preferred that the second embodiment shown in FIGS. 5–9 includes a card dispensing means as discussed above, this embodiment is directed primarily to a novel card advance means which may be used in a card dispenser having any type of front wall, such as conventional card dispensers in which the front wall has an opening through which the operator or dealer directly contacts the card.

In this embodiment, a gravitationally advanced card advance means or card pusher 70 is constructed with a generally planar pusher plate 72 protruding above the inclined floor 22' for contacting the trailing card 34' of the stack of cards 30' and a weight 80 extending below the inclined floor 22'. This arrangement permits the dispenser 10' to be loaded with a greater number of cards 30' than would otherwise be possible. As discussed above, the greater the number of cards used in forming the stack of cards 30', the less likely a card counter will be effective.

Figure 8:
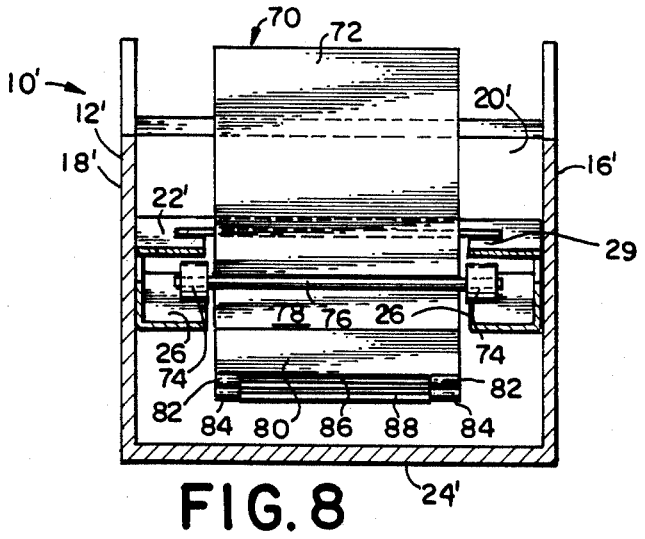
FIG. 8 is a partial vertical sectional view taken along the plane of the line 8—8 of FIG. 5.
Figure 9:
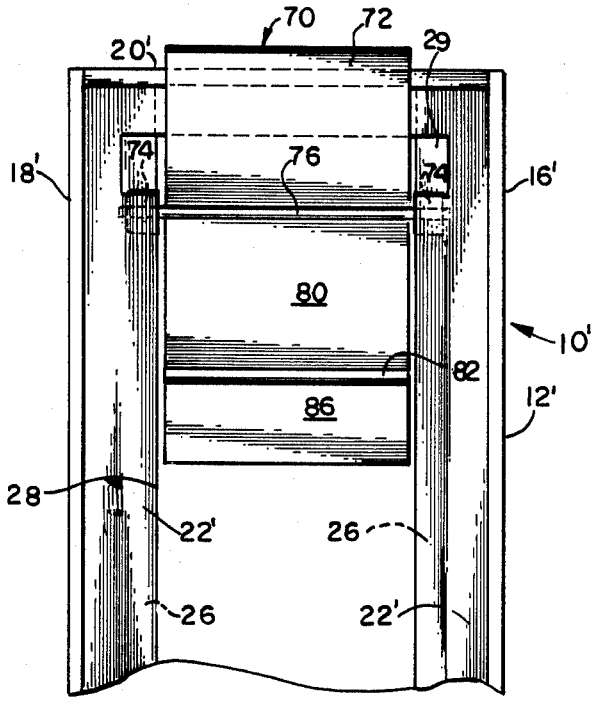
FIG. 9 is a partial plan view of the dispenser of FIG. 5 taken along the plane of line 9—9 of FIG. 5.

As best seen in the sectional view of FIG. 8 and the partial plan view of FIG. 9, in this embodiment the inclined floor 22' contains an elongated aperture 28 extending from proximate the back wall 20' to proximate the front wall 14' (not shown). The pusher plate 72 is secured to the gravitational advance means or weight 80 by a pusher plate biasing means or mount 78 extending between the pusher plate 72 and the weight 80. The pusher plate 72 is oriented at an acute angle with respect to the inclined floor 22', similar to the front wall of the housing 6 of the card pusher 60 in the first embodiment described above. The mount 78 is securely affixed to both the pusher plate 72 and the weight 80. A shaft 76 is securely affixed to the mount 78 between the pusher plate 72 and the weight 80. The ends of the shaft 76 extend beyond the mount 78 and a pair of wheels 74 are rotatably mounted on the ends of the shaft 76, as best seen in FIGS. 8 and 9.

In this embodiment, a pair of rails 26 are secured to the inner sides of the side walls 16', 18' of the shoe 12'. The rails 26 are secured below and parallel to and spaced from the floor 22' and are adapted to be contacted by the wheels 74 of the card pusher 70. Thus, the rails 26 form a track to support the card pusher 70 upon which the card pusher 70 can gravitationally advance. The card pusher 70 is mounted on the rails 26 by being inserted into an aperture 29, best seen in FIGS. 8 and 9, formed in the floor 22' near the back wall 20'. The aperture 29 is dimensioned so that the wheels 74 fit easily into the aperture to allow for convenient insertion and removal of the card pusher 70 into the shoe 12'. When the card pusher 70 is mounted on the track, the pusher plate 72 extends above the floor 22' and the mount 78 extends through the elongated aperture 28 in the floor 22'. The weight 80 is then located beneath the floor 22' and above the base 24'.

Figure 5:
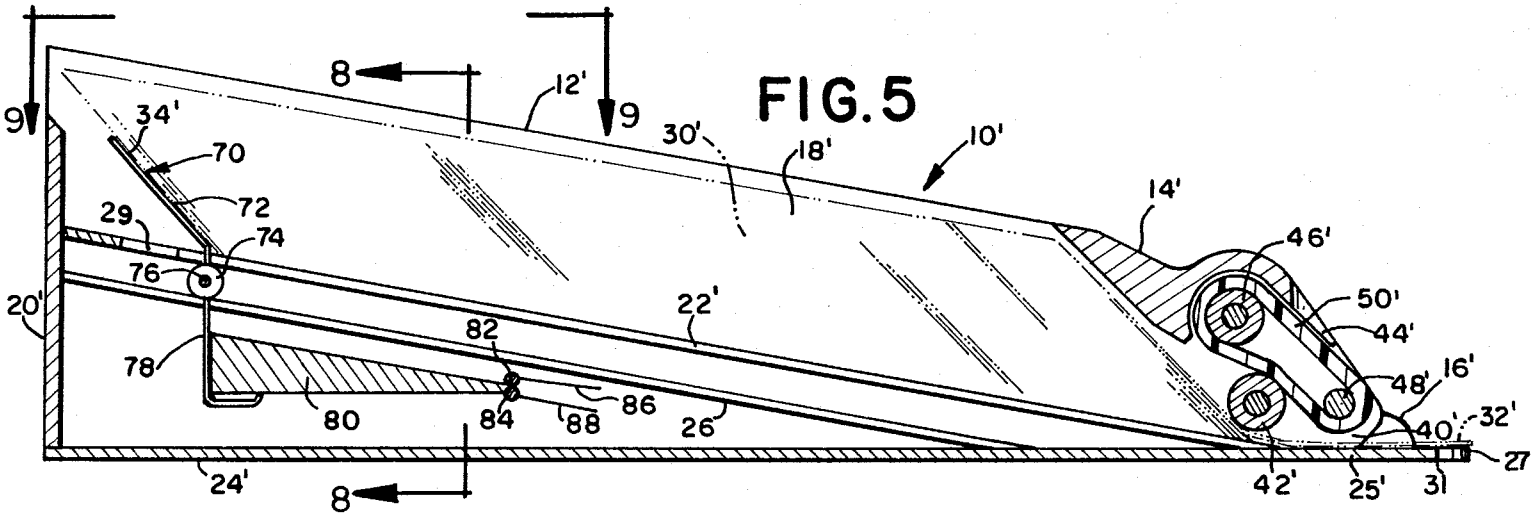
FIG. 5 is a side elevational view, partially in vertical section, of another embodiment of the present invention showing the card advance means in a first, initial position.
Figure 6:
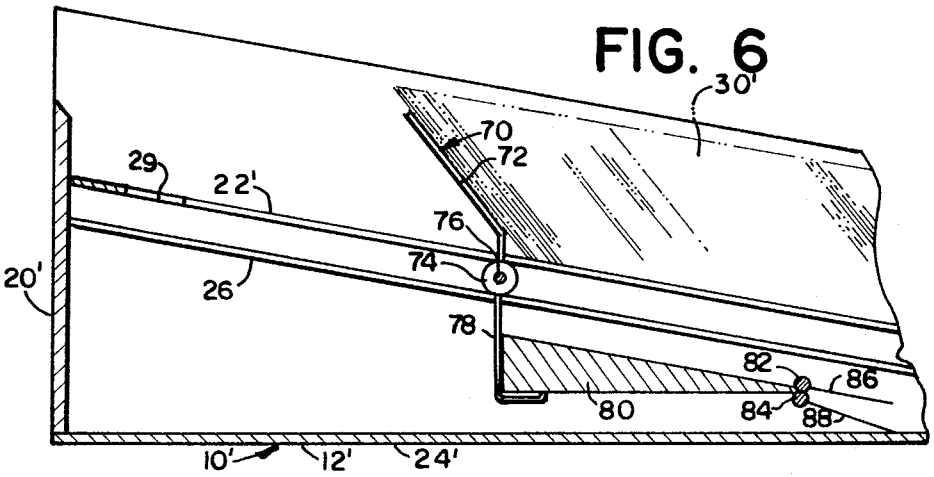
FIG. 6 is a partial vertical sectional view of the dispenser of FIG. 5 showing the card advance means in a second signalling position.
Figure 7:
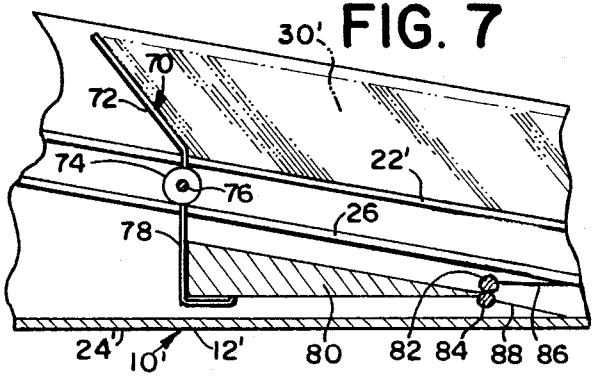
FIG. 7 is another partial vertical sectional view of the dispenser of FIGS. 5 and 6 showing the card advance means in a third terminal position.

As best seen in FIGS. 5–7, the card pusher preferably includes an upper and a lower bumper 82, 84 and an upper and a lower feeler plate 86, 88 mounted on the weight 80 proximate the front end thereof. The purpose of the upper and lower feeler plates 86, 88 is to detect and signal advancement of the card advance means or card pusher 70 beyond at least one predetermined position. When the card pusher 70 advances from a first, initial position for loading as illustrated in FIG. 5 to a second, predetermined position as illustrated in FIG. 6, the lower feeler plate 88 contacts the top surface of the base 24' and the rate of advancement of the card pusher 70 is subsequently retarded. This alerts the operator that the card pusher 70 is at the first predetermined position.

As the card pusher 70 advances further down the inclined floor 22', the upper feeler plate 86 contacts the lower surface of the rails 75 at a third predetermined position as illustrated in FIG. 7. The rate of advancement of the card pusher 70 is further retarded and is stopped by contact of either the upper bumper 82 with the lower surface of the inclined rails 75 or the lower bumper 84 with the upper surface of the base 24', respectively. Alternatively, other means such as electrical or optical means known to those skilled in the art may be provided to detect and signal advancement of the card advance means beyond at least one predetermined position.

Although it is preferred that the second embodiment of the present invention illustrated in FIG. 5–9 include the removal roller assembly 35 as described above with respect to FIGS. 1–4, FIG. 5 illustrates that the card dispensing means of the present invention is operative without and need not include the optional removal roller assembly 35. Where the removal roller assembly is not used, the front end of the dispenser 10' preferably has the structure illustrated in FIG. 5. With reference to the area located in front of the front wall 14' in FIG. 5, the lower edge of the first or left side wall 16' extends further forward than the second or right side wall 18'. The side walls 16', 18' extend so that a card positioned in the predetermined position in the slot 40' has a corner extending beyond the lower edge of the second wall 18', the lower edge of the first side wall 16' extending beyond another corner of the card in the predetermined position.

The forward end 25' of the base 24' extends from proximate the left side wall 16' to proximate the right side wall 18' and has two generally arcuate corners 27, 31. A first or left front corner 27 located proximate the left side wall 16' is adapted to support one corner of a card located in the predetermined position in the slot 40'. A second or right front corner 31 is located proximate the right side wall 18'. When the leading card 32' has been advanced into and through the slot 40' by the operator, the corner of the leading card 32' proximate the second corner 31 protrudes beyond the base 24' so that the corner of the protruding leading card 32 can be grasped easily between the finger tips of the operator and withdrawn from the dispenser 10'. This arrangement is the preferred arrangement for a right-handed operator. If a left-handed operator is using the dispenser, the removal components described in this paragraph would be arranged to be a mirror image for a right-handed operator. For example, the lower edge of left side wall 16' would be shorter than the lower edge of right side wall 18', so that the leading card could be removed more readily from the slot by grasping the left front corner of the card.

The walls, floor and base of the dispenser are preferably formed from rigid opaque polymeric plastic materials such as are generally known in the art. The shafts of the rollers are preferably formed from a strong metallic material such as steel. The resilient portion of the contact and inner rollers 42, 46, 48 and the belt 50 are preferably formed from a natural or synthetic rubber. The pusher plate 72 and mount 78 of the card pusher 70 of the second embodiment described above are preferably formed from a metallic or rigid polymeric plastic material. The weight 80 of this card pusher 70 is preferably formed from a highly dense material such as steel or lead. However, any materials which will achieve the utility characteristics of the various parts of the dispenser 10 may be used.

Use of the dispenser greatly reduces the advantage of card counting, since the player has a reduced ability to foretell, prior to betting, the identity or characteristics of the leading card which is dealt from the dispenser.

The present invention may be embodied in other specific forms without departing from the spirit or essential attributes thereof. Accordingly, reference should be made to the appended claims, rather than to the foregoing specification, as indicating the scope of the invention.

I claim:

1. A dispenser for playing cards comprising:

a shoe adapted to contain a plurality of stacked playing cards, the playing cards including a leading card and a trailing card; the shoe including a back wall, first and second side walls, a front wall, a base, and an inclined floor extending from the back wall to proximate the front wall and adapted to support the playing cards; the floor being inclined downwardly from the back wall to the front wall; the front wall having an opening and otherwise being adapted to conceal the leading card; and the front wall, side walls, base and floor enclosing a slot positioned adjacent the floor, the slot being sized to permit a playing card to pass through the slot;

card advances means contacting the trailing card and adapted to urge the stacked cards down the inclined floor;

card dispensing means positioned proximate the front wall and adapted to dispense a single card at a time, the card dispensing means including leading card contact means adapted for rotation about an axis parallel to the leading card, whereby rotation of the leading card contact means displaces the leading card relative to the card stack and into a predetermined position extending out of the shoe from the slot; and an endless belt located in the opening in the front wall for rotating the leading card contact means, the endless belt having an exterior surface securely engaging the leading card contact means and being adapted to be displaced by an operator.

2. A dispenser according to claim 1 wherein the leading card contact means includes a generally cylindrical contact roller for contacting the leading card and having a circumference smaller than the size of the cards, the contact roller being supported by the side walls and positioned proximate the front wall and the floor, whereby rotation of the contact roller advances the leading card into and at least partially out of the slot for dispensing the leading card.

3. A dispenser according to claim 1 wherein the dispenser further includes a pair of spaced generally cylindrical inner rollers rotatably mounted on the side walls proximate the opening in the front wall, the endless belt securely engaging the inner rollers and extending therebetween, the inner rollers being spaced by a predetermined distance such that displacement of the endless belt by the operator by a distance equal to the predetermined distance causes rotation of the contact roller to advance the leading card into and substantially out of the slot and into a predetermined position.

4. A dispenser according to claim 1 wherein the card advance means urges the stacked cards down the floor by gravity acting on the card advance means.

5. A dispenser according to claim 1 wherein the front wall includes a cover section extending generally parallel to the floor for shielding from view the top edges of a portion of the stacked cards proximate the leading card.

6. A dispenser according to claim 5 wherein the cover section is generally rectangular and includes a rear directed edge, the rear edge including a cutout portion for facilitating removal of cards from the shoe.

7. A dispenser for playing cards comprising:

a shoe adapted to contain a plurality of stacked playing cards, the playing cards including a leading card and a trailing card; the shoe including a back wall, side walls, a front wall, and an inclined floor extending from the back wall to the front wall and adapted to support the playing cards; the floor being inclined downwardly from the back wall to the front wall; the floor containing an elongated aperture extending from proximate the back wall to proximate the front wall of the shoe; and the front wall, side walls and floor enclosing a slot positioned adjacent the floor, the slot being sized to permit a playing card to pass through the slot; and card advance means adapted to urge the stacked cards down the inclined floor and extending through the aperture in the floor; the card advance means including a pusher plate located above the floor for contacting the trailing card, and gravitational advance means located below the floor.

8. A dispenser according to claim 7 wherein the card advance means includes pusher plate biasing means connecting the pusher plate and the gravitational advance means, the biasing means extending through the aperture for biasing the pusher plate forward to contact and press upon the trailing card.

9. A dispenser according to claim 8 wherein the shoe is adapted to support the gravitational advance means so that the card advance means is displacable parallel to the floor.

10. A dispenser according to claim 7 wherein the dispenser further includes card dispensing means positioned in the front wall and adapted to dispense a single card at a time, the card dispensing means including leading card contact means adapted for rotation about an axis parallel to the leading card, whereby rotation of the leading card contact means displaces the leading card relative to the card stack and into a predetermined position extending out of the shoe from the slot.

11. The dispenser according to claim 7 further comprising track means located beneath the inclined floor, generally parallel to and spaced from the inclined floor, for supporting the card advance means, and wherein the card advance means further is adapted to cooperate with the track means for supporting the card advance means from the track means beneath the inclined floor.

12. A dispenser for playing cards comprising:

a shoe adapted to contain a plurality of stacked playing cards, the playing cards including a leading card and a trailing card; the shoe including a back wall, first and second side walls, a front wall, a base, and an inclined floor extending from the back wall to proximate the front wall and adapted to support the playing cards; the floor being inclined downwardly from the back wall to the front wall; the front wall being adapted to conceal the leading card; and the front wall, side walls, base and floor enclosing a slot positioned adjacent the floor, the slot being sized to permit a playing card to pass through the slot;

card advance means contacting the trailing card and adapted to urge the stacked cards down the inclined floor;

card dispensing means positioned proximate the front wall and adapted to dispense a single card at a time, the card dispensing means including leading card contact means adapted for rotation about an axis parallel to the leading card, whereby rotation of the leading card contact means displaces the leading card relative to the card stack and into a predetermined position extending out of the shoe from the slot;

wherein at least one removal roller is mounted on the dispenser and positioned below the leading card contact means, the removal roller having an outer cylindrical surface in which a tangent plane is generally flush with the floor, whereby rotation of the leading card contact means displaces the leading card relative to the card stack such that the leading card extends out of the shoe from the slot and is supported by the removal roller;

wherein the removal roller includes a first end supported by a first support means aligned with the first side wall and a second end supported by a second support means aligned with the second side wall; and wherein the first side wall is the left side wall and the second wall is the right side wall looking from the back wall to the front wall of the shoe, the second support means having a height extending above the outer cylindrical surface of the removal roller to prevent the leading card from being slid off of the surface of the removal roller toward the second side wall without lifting up the leading card.

13. A dispenser according to claim 12 wherein a plurality of removal rollers are mounted adjacent to each other, each removal roller having an outer cylindrical surface aligned with the outer cylindrical surface of adjacent removal rollers, such that the removal rollers support the leading card as it is being dispensed from the shoe through the slot.

14. A dispenser according to claim 12 wherein the first support means has a height no higher than the top of the outer cylindrical surface of the removal roller.

15. A dispenser according to claim 12 wherein the first support means includes an integral extension of the first side wall and the second support means includes an integral extension of the second side wall.

16. A dispenser for playing cards comprising:

a shoe adapted to contain a plurality of stacked playing cards, the playing cards including a leading card and a trailing card; the shoe including a back wall, first and second side walls, a front wall, a base, and an inclined floor extending from the back wall to proximate the front wall and adapted to support the playing cards; the floor being inclined downwardly from the back wall to the front wall; the front wall being adapted to conceal the leading card; and the front wall, side walls, base and floor enclosing a slot positioned adjacent the floor, the slot being sized to permit a playing card to pass through the slot;

card advance means contacting the trailing card and adapted to urge the stacked cards down the inclined floor;

card dispensing means positioned proximate the front wall and adapted to dispense a single card at a time, the card dispensing means including leading card contact means adapted for rotation about an axis parallel to the leading card, whereby rotation of the leading card contact means displaces the leading card relative to the card stack and into a predetermined position extending out of the shoe from the slot; and means for detecting and signalling advancement of the card advance means beyond at least one predetermined position.

17. A dispenser according to claim 12 wherein the card advance means further includes means for detecting advancement of the card advance means beyond at least one predetermined position.

18. A dispenser according to claim 17 wherein the card advance means includes means for stopping the advancement of the card advance means at a predetermined position.

19. A dispenser for playing cards comprising:

a shoe adapted to contain a plurality of stacked playing cards, the playing cards including a leading card and a trailing card; the shoe including a back wall, first and second side walls, a front wall, a base, and an inclined floor extending from the back wall to proximate the front wall and adapted to support the playing cards; the floor being inclined downwardly from the back wall to the front wall; the front wall being adapted to conceal the leading card; and the front wall, side walls, base and floor enclosing a slot positioned adjacent the floor, the slot being sized to permit a playing card to pass through the slot;

card advance means contacting the trailing card and adapted to urge the stacked cards down the inclined floor;

card dispensing means positioned proximate the front wall and adapted to dispense a single card at a time, the card dispensing means including leading card contact means adapted for rotation about an axis parallel to the leading card, whereby rotation of the leading card contact means displaces the leading card relative to the card stack and into a predetermined position extending out of the shoe from the slot; and wherein the side walls include a side wall with a shorter lower edge than the other side wall, the side walls extending so that a card positioned in the predetermined position in the slot has a corner extending beyond the side wall with the shorter lower edge, the lower edge of the other side wall extending beyond another corner of the card in the predetermined position.

20. A dispenser according to claim 19 wherein the base has two generally arcuate corners including a first corner located proximate the side wall with the shorter lower edge and a second corner located proximate the side wall with the longer lower edge, the first corner being adapted to permit the card in the predetermined position to be grasped by an operator and withdrawn from the dispenser, and the second corner being adapted to support one corner of a card located in the predetermined position.

21. A dispenser for playing cards comprising:

a shoe adapted to contain a plurality of stacked playing cards, the playing cards including a leading card and a trailing card; the shoe including a back wall, first and second side walls, a front wall, a base, and an inclined floor extending from the back wall to proximate the front wall and adapted to support the playing cards; the floor being inclined downwardly from the back wall to the front wall; the front wall being adapted to conceal the leading card; and the front wall, side walls, base and floor enclosing a slot positioned adjacent the floor, the slot being sized to permit a playing card to pass through the slot;

card advance means contacting the trailing card and adapted to urge the stacked cards down the inclined floor;

card dispensing means positioned proximate the front wall and adapted to dispense a single card at a time, the card dispensing means including leading card contact means adapted for rotation about an axis parallel to the leading card, whereby rotation of the leading card contact means displaces the leading card relative to the card stack and into a predetermined position extending out of the shoe from the slot; and card removal means positioned proximal the slot and including support surface means generally adapted for receiving and supporting the leading card dispensed through the slot by rotation of the leading card contact means, the card removal means including two lateral sides extending generally transversely away from the slot on opposing sides of the support surface means, the card removal means being adapted at one of the two lateral sides to prevent the leading card from being slid off the support surface means at the one lateral side without lifting the leading card from the support surface means and the card removal means being adapted at the other lateral side to permit the leading card to be slid off the support surface means at the other side without lifting the leading card from the support surface.

* * * * *